US011141948B1

(12) United States Patent
Miller et al.

(10) Patent No.: US 11,141,948 B1
(45) Date of Patent: Oct. 12, 2021

(54) ROBOTIC SYSTEM FOR ERECTING A ONE-PIECE INSULATING CONTAINER

(71) Applicant: ThermoPod, LLC, Mobile, AL (US)

(72) Inventors: Drayton G. Miller, Mobile, AL (US); William J. Gunn, Springfield, IL (US)

( * ) Notice: Subject to any disclaimer, the term of this patent is extended or adjusted under 35 U.S.C. 154(b) by 125 days.

(21) Appl. No.: 16/537,553

(22) Filed: Aug. 10, 2019

Related U.S. Application Data

(60) Provisional application No. 62/717,140, filed on Aug. 10, 2018.

(51) Int. Cl.

| | |
|---|---|
| ***B31B 50/00*** | (2017.01) |
| ***B31B 50/26*** | (2017.01) |
| ***B31B 50/06*** | (2017.01) |
| ***B31B 50/62*** | (2017.01) |
| *B31B 150/00* | (2017.01) |
| *B65D 81/127* | (2006.01) |
| *B65D 81/38* | (2006.01) |

(52) U.S. Cl.
CPC ..... *B31B 50/262* (2017.08); *B31B 50/06* (2017.08); *B31B 50/624* (2017.08); *B31B 2150/001* (2017.08); *B65D 81/1275* (2013.01); *B65D 81/3858* (2013.01)

(58) Field of Classification Search
CPC ..... B31B 50/06; B31B 50/07; B31B 50/26; B31B 50/262; B31B 50/624; B31B 2150/001; B65D 5/0281; B65D 81/022; B65D 81/1275; B65D 81/38; B65D 81/3858
USPC ..... 493/51, 52, 69, 70, 79, 93, 94; 53/456, 53/458, 472, 558, 564
See application file for complete search history.

(56) References Cited

U.S. PATENT DOCUMENTS 3,980,005 A * 9/1976 Buonaiuto ..... B65D 5/566 427/289
4,006,670 A * 2/1977 Royal ..... B65D 5/2052 493/10
4,009,646 A * 3/1977 Mott ..... B31B 50/00 493/93
4,662,150 A * 5/1987 Johnson ..... B65B 43/265 493/313

(Continued)

FOREIGN PATENT DOCUMENTS

FR 1293959 A * 7/1961 ..... B65D 81/3858
FR 1293959 A * 5/1962 ..... B65D 81/3858

OTHER PUBLICATIONS

U.S. Appl. No. 16/128,505, filed Sep. 11, 2018, Drayton G. Miller.

(Continued)

*Primary Examiner* — Hemant Desai
*Assistant Examiner* — Jacob A Smith
(74) *Attorney, Agent, or Firm* — AdamsIP, LLC

(57) ABSTRACT

An automated case erector for erecting a one-piece insulating container and a method of automated case erecting are provided. The automated erector includes a case blank feeder for sequentially feeding a series of flat case blanks onto a conveyor, an insulation securing station for securing insulating members to the case blank, and a case erecting assembly for forming the combination of case blanks and insulating members secured thereto into a fully erected, three-dimensional container by simultaneously folding the combination of case blanks and insulating members.

16 Claims, 5 Drawing Sheets

(56) References Cited

U.S. PATENT DOCUMENTS

| | | | | |
|---|---|---|---|---|
| 5,651,851 | A * | 7/1997 | Gatcomb | B32B 38/04 156/250 |
| 6,007,467 | A * | 12/1999 | Becker | B65D 5/3685 493/906 |
| 6,220,473 | B1 * | 4/2001 | Lehman | B65D 81/3858 150/901 |
| 6,849,037 | B1 * | 2/2005 | Sanders | B65D 81/02 493/116 |
| 7,329,456 | B2 * | 2/2008 | Tilton | E04B 1/86 181/224 |
| 7,784,301 | B2 * | 8/2010 | Sasaki | B65D 11/18 62/457.2 |
| 9,611,067 | B2 * | 4/2017 | Collison | B65D 81/3862 |
| 2004/0214705 | A1 * | 10/2004 | Gardner | B31B 50/00 493/93 |
| 2008/0070769 | A1 * | 3/2008 | Graham | B65D 5/36 493/70 |
| 2012/0111869 | A1 * | 5/2012 | Green | B65D 5/563 220/560.01 |
| 2015/0336704 | A1 * | 11/2015 | James | B65D 5/6664 229/142 |
| 2015/0360433 | A1 * | 12/2015 | Feijen | B31B 50/74 53/456 |
| 2016/0159026 | A1 * | 6/2016 | Porteous | B65G 59/068 493/126 |
| 2019/0077576 | A1 * | 3/2019 | Miller | B65D 81/1275 |
| 2019/0143627 | A1 * | 5/2019 | Giovanneschi | B31B 50/26 493/18 |

OTHER PUBLICATIONS

U.S. Appl. No. 16/203,580, filed Nov. 28, 2018, Drayton G. Miller.
U.S. Appl. No. 16/537,550, filed Aug. 10, 2019, Drayton G. Miller.

* cited by examiner

ROBOTIC SYSTEM FOR ERECTING A ONE-PIECE INSULATING CONTAINER

CROSS REFERENCES

This application claims the benefit of U.S. Provisional Application No. 62/717,140, filed on Aug. 10, 2018, which application is incorporated herein by reference.

FIELD OF THE DISCLOSURE

The subject matter of the present disclosure refers generally to an automated case erector for erecting containers and a method of using the automated case erector for erecting containers that provide cushioned protection and temperature control for contents of the containers.

BACKGROUND

When shipping fragile or temperature-sensitive items, consumers generally have a limited number of container options that provide both insulation and cushioning sufficient to maintain and protect those items during transit. For spatially smaller shipments or mailings, paper envelopes lined with plastic bubble wrap are sometimes used. However, these envelopes generally provide limited impact protection and virtually no insulation and thus are often unsuitable for fragile and/or temperature-sensitive items. In some instances, rolls of bubble wrap may be utilized to wrap individual items, thereby equipping such items with an additional layer of padding during shipping. However, wrapping individual items in this manner may prove inconvenient, time-consuming, and costly—particularly for irregularly shaped items requiring shipment. Moreover, because mail carriers often do not permit the shipment of items encased in bubble wrap alone, items wrapped in bubble wrap generally must be placed within a container before the item can be shipped, which further increases the time, effort, and cost associated with shipping the item. For spatially larger items, containers, such as corrugated boxes, may be used. However, the corrugated walls of such boxes provide very little cushioning and, thus, generally cannot withstand significant impacts without the structural integrity of the container being compromised and the item stored therein being damaged. Additionally, because the corrugated boxes currently used in the field are generally corrugated in a manner such that the interior of a box's walls contains a substantial amount of air therein, corrugated boxes currently used in the field are generally poor insulators, and, as such, cannot be utilized in the shipment of temperature-sensitive items. Although boxes or other containers having expanded polystyrene inside the container may be used to help maintain temperature, expanded polystyrene provides limited cushioning and additionally is generally non-biodegradable.

In some instances, foam peanuts or plastic pillows inflated with air may be used in conjunction with certain shipping containers to minimize the empty space present within the container. However, because these packaging devices generally do not occupy the entirety of the internal volume of the container not occupied by the item being shipped, both the foam peanuts or inflated plastic pillows as well as the item being shipped may shift within the container during transit, often resulting in breakage of the shipped item. Moreover, because foam peanuts and inflated plastic pillows are generally not designed to insulate or resist temperature change, these packaging devices generally cannot be relied upon when shipping temperature-sensitive items, such as perishable food products.

Currently, thermal liners and a variety of refrigerants, such as ice packs or gel packs, are relied upon to regulate the temperature within a shipping container's interior volume. However, such liners and refrigerants are generally not components of the shipping container itself, but rather are separate elements designed to be placed or installed within a shipping container once the shipping container is fully constructed. Accordingly, to ship temperature-sensitive items using known containers, such as corrugated boxes, and liners and/or refrigerants, the container often must be manipulated from its generally flat template form into its constructed, three-dimensional box form and the liners and/or refrigerants subsequently installed within the interior volume of the box. Often, installation of the liners and/or refrigerants must be done by hand as such materials must be placed with precision to ensure the interior volume of the container exhibits proper thermal regulation. Accordingly, the step of installing or otherwise associating such liners and/or refrigerants with known shipping containers only after the container has been manipulated into a three-dimensional form often increases the time, effort, and costs associated with shipping temperature-sensitive items.

Accordingly, shippers who require cushioning and/or insulation for the shipment of fragile and/or temperature-sensitive items have a need for an improved, simplified, one-piece container that provides both cushioning and insulation for shipping such items. However, for large-scale commercial shippers who ship such containers in high volume, an additional need exists in the art for an automated case erector apparatus designed to erect such containers at a rate sufficient to meet the needs of such commercial shippers.

SUMMARY

In accordance with the present disclosure, an automated case erector apparatus and a method of using the apparatus to erect cases with interior cushioned insulation are provided. The case erector is configured to erect a one-piece container having an exterior formed from a case blank and insulation disposed within the interior of the container. The insulation is secured to the generally flat case blank before erecting the case, and the case erector erects the container by simultaneously folding the case blank and insulation as a single unit into a three-dimensional container. The case erector comprises a case blank feeder configured to sequentially feed a series of flat case blanks onto a conveyor, an insulation securing station configured to secure an insulating member to a flat case blank, and a case erecting assembly configured to simultaneously fold portions of the flat case blank and corresponding portions of the insulating member secured thereto into an erected container that may be used for shipping items requiring cushioning and/or thermal insulation. Thus, the present automated case erector may be utilized to erect a container as a single unit without requiring a container to be formed from a case blank into a three-dimensional form before insulation material is associated therewith. The automated case erector may be used to construct a high volume of insulated containers in a single process by eliminating the necessity of manually installing insulation into a previously constructed shipping container prior to shipping items in the container.

The erected container is designed to provide a completely enclosed interior space within the container that is cushioned and insulated on all sides. The case blank is a template configured to transform from a generally flat configuration into a three-dimensional container by folding the case blank along defined fold lines. The insulation is provided as an insulation template designed to cushion and insulate an interior volume of the container once the container has been erected. The insulation template is secured to the case blank by the automated case erector while both are in a generally flattened state. The case erector then simultaneously folds both the case blank and corresponding portions of the insulation template to simultaneously transform both from a generally flat configuration into a three-dimensional container. The dimensions of the case blank and the insulation template may be adjusted to form containers of varying size and dimension. For instance, the dimensions of the case blank and the insulation template may be adjusted to correspond to standard sized cardboard boxes used by the United States Postal Service or other freight carriers, such as FedEx or UPS, for shipping items.

The insulation template comprises at least one insulating member. Each insulating member comprises a soft, flexible material that can be readily compressed and deformed to enable the template to conform to the shape formed by the case blank and to provide cushioning and insulation for items placed within the container. Each insulating member preferably comprises cotton fibers to act as a cushioning agent. In one embodiment, each insulating member may comprise a bi-component fiber including cotton fibers and another type of fiber, such as polyester fibers or polyethylene fibers, which may be present in an amount sufficient to hold the cotton fibers together in order to form a distinct, defined section of insulating material. The thickness of each insulating member may vary depending on the dimensions of the container and the desired amount of cushioning or insulation to be provided therein. Each insulating member is preferably encapsulated and sealed within a flexible plastic material such as a bag or a film. The encapsulating material ensures that the insulation is contained and isolated from the shipped contents in the interior of the container. The encapsulating material also facilitates gripping of the insulating members by the automated case erector, as well as securing the insulating members to the case blank prior to folding the combination of case blank and insulating members into a three-dimensional shape.

The foregoing summary has outlined some features of the apparatus, system, and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the apparatus and system disclosed herein. Those skilled in the pertinent art should also realize that such equivalent designs or modifications do not depart from the scope of the apparatus, system and methods of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
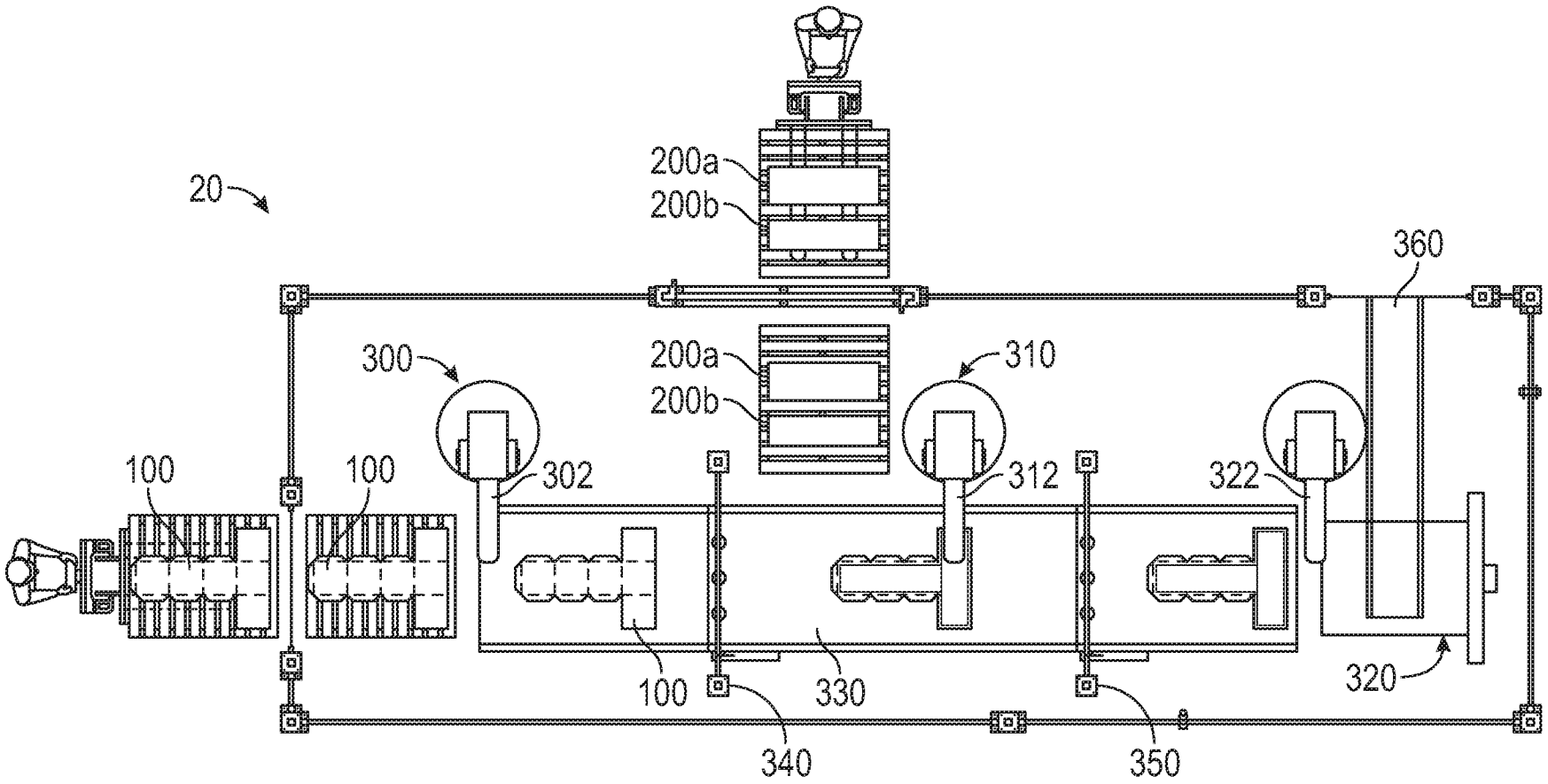
FIG. 1 shows a schematic diagram of an automated case erector apparatus in accordance with the present disclosure.

In accordance with the present disclosure, an automated case erector apparatus 20 is provided. FIG. 1 shows a schematic diagram of an illustrative automated case erector 20. The case erector 20 is configured to erect a one-piece container 10 having an exterior formed from a case blank 100 and insulation 200 disposed within the interior of the container. The insulation is provided as a generally flat insulation template 200, which is secured to the case blank 100 before erecting the case 10, and the case erector 20 erects the container 10 by simultaneously folding the case blank 100 and insulation template 200 as a single unit in combination into a three-dimensional container 10. The insulation template 200 may comprise one or more separate insulating members 200*a*, 200*b*. The case erector comprises a case blank feeder 300 configured to sequentially feed a series of flat case blanks 100 onto a conveyor 330, an insulation securing station 310 configured to secure an insulation template 200 to each respective flat case blank 100 on the conveyor 330, and a case erecting assembly 320 configured to receive each case blank 100 having a respective insulation template 200 secured to the case blank 100. The case erecting assembly 320 is further configured to simultaneously fold portions of the flat case blank 100 and corresponding portions of the insulation template 200 secured to the case blank 100 into an erected case 10, or container, that may be used for shipping items requiring cushioning and/or thermal insulation. Thus, the present automated case erector 20 may be utilized to erect a container 10 as a single unit without requiring the container to be formed into a three-dimensional configuration prior to insulation material being associated with the container. The automated case erector 20 may be used to construct a high volume of insulated containers 10 in a single process by eliminating the necessity of manually installing insulation within a shipping container after constructing the container and prior to shipping items in the container.

Figure 2:
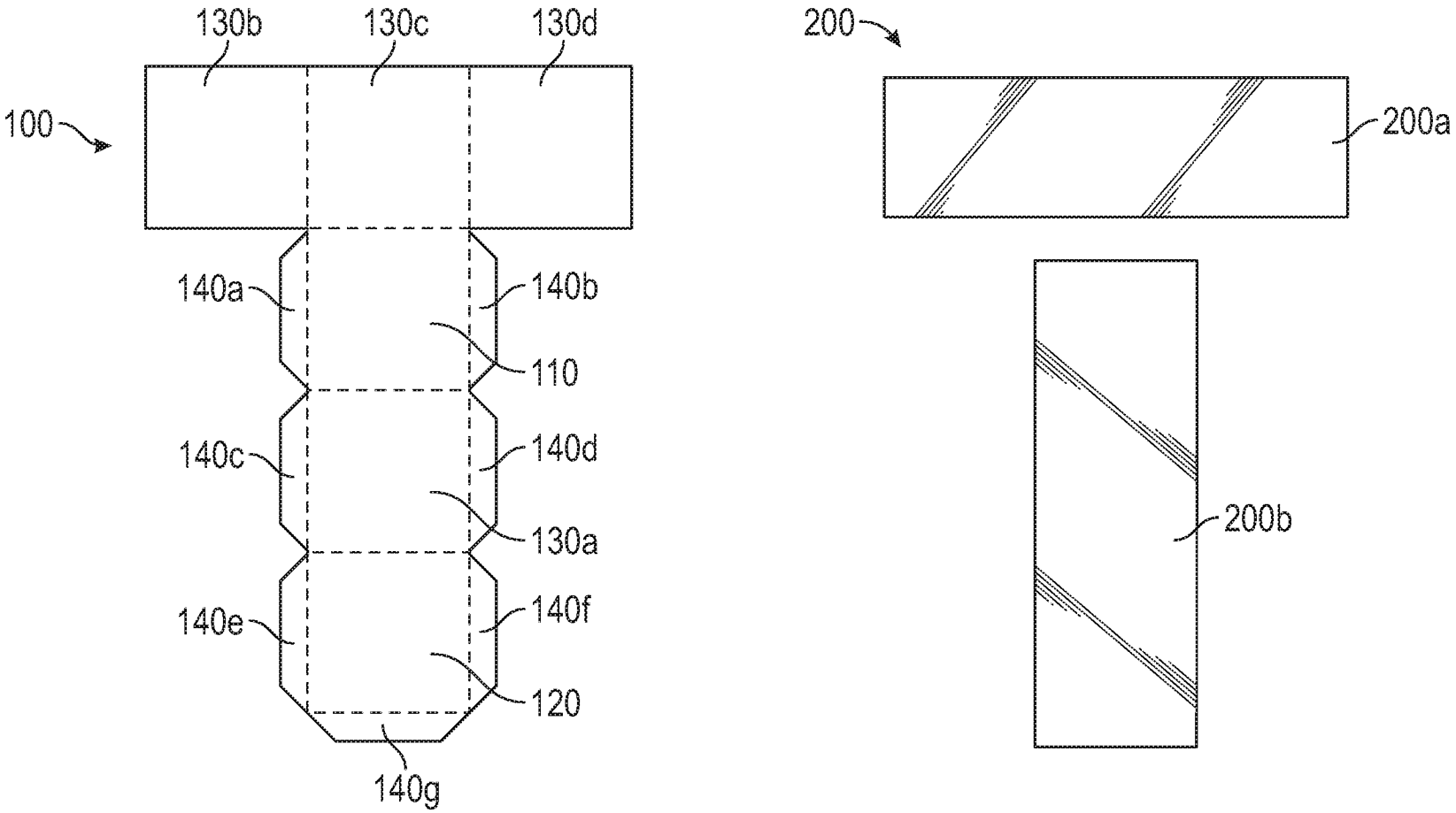
FIG. 2 shows a top view of an illustrative case blank and insulation template that may be formed into a three-dimensional container using the automated case erector shown in FIG. 1 in accordance with the present disclosure.
Figure 4:
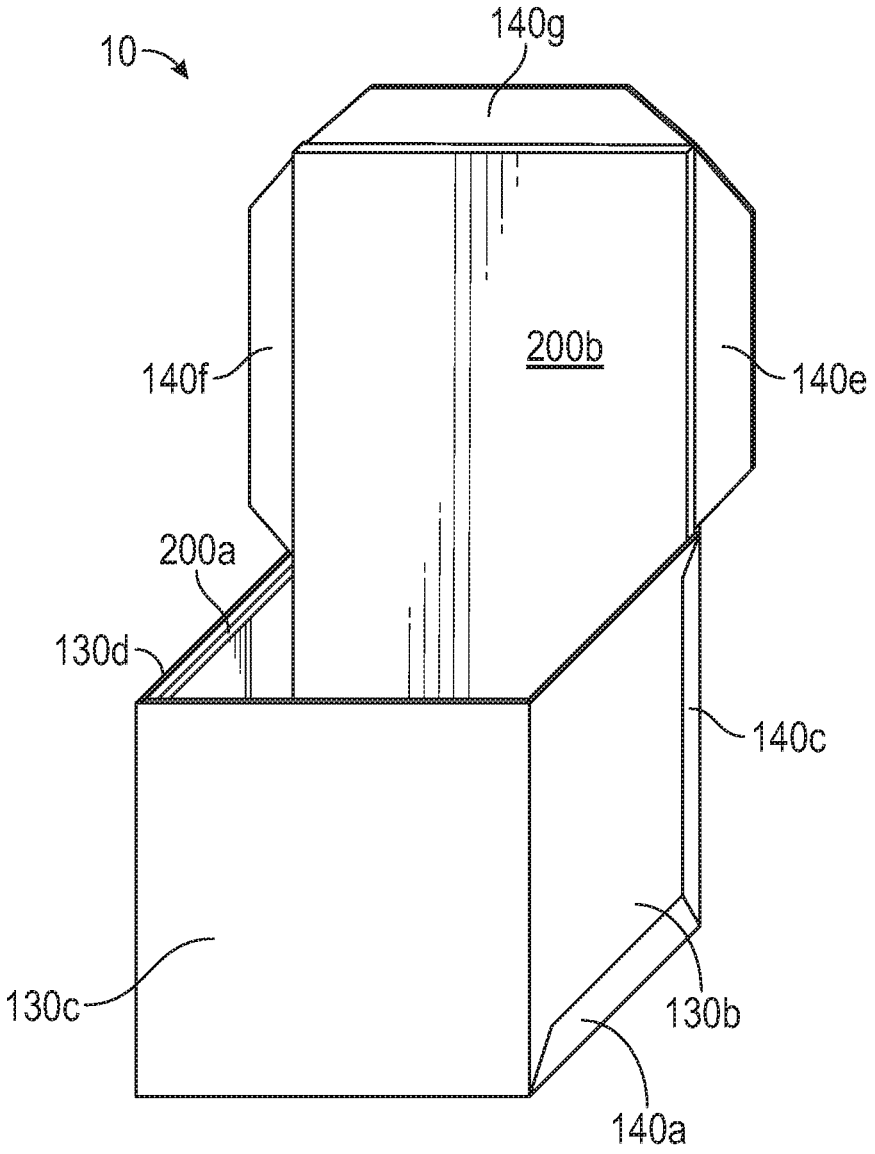
FIG. 4 shows a perspective view of an illustrative container that may be formed using the automated case erector shown in FIG. 1 in accordance with the present disclosure.

The erected container 10 is designed to provide a completely enclosed interior space that is cushioned and insulated on all sides. The case blank is a template 100 configured to transform from a generally flat configuration, as shown in FIG. 2, into a three-dimensional container, as shown in FIG. 4, by folding the case blank 100 along defined fold lines. The insulation is provided as an insulation template 200 designed to cushion and insulate an interior volume of the container once the container 10 has been erected. The insulation template 200 is secured to the case blank 100 by the automated case erector 20 while both are in a generally flattened state. The case erector 20 then simultaneously folds both the case blank 100 and corresponding portions of the insulation template 200 to transform both from a generally flat configuration into a three-dimensional container 10. The dimensions of the case blank 100 and the insulation template 200 may be adjusted to form containers 10 of varying sizes and dimensions. For instance, the dimensions of the case blank 100 and the insulation template 200 may be adjusted to correspond to standard sized cardboard boxes used by the United States Postal Service or other freight carriers, such as FedEx or UPS, for shipping items.

Each insulation template 200 comprises at least one insulating member. In a preferred embodiment, each insulation template 200 may comprise two separate insulating members 200*a* and 200*b*. Each insulating member comprises a soft, flexible material that can be readily compressed and deformed to enable the template 200 to conform to the shape formed by the case blank 100 and to provide cushioning and insulation for items placed within the erected container 10. Each insulating member preferably comprises cotton fibers to act as a cushioning agent. In one embodiment, each insulating member may comprise a bi-component fiber including cotton fibers and another type of fiber, such as polyester fibers or polyethylene fibers, which may be present in an amount sufficient to hold the cotton fibers together in order to form a distinct, defined section of insulating material. The thickness of each insulating member may vary depending on the dimensions of the container and the desired amount of cushioning or insulation to be provided therein. Each insulating member is preferably encapsulated and sealed within a flexible plastic material such as a bag or a film. For instance, the insulating material of each insulating member may be encapsulated within polyethylene plastic or a polyester sheet. The external layer of each insulating member and/or the insulating material contained therein may be biodegradable. The encapsulating material ensures that the insulation is contained and isolated from the shipped contents within the interior of the container. The encapsulating material also facilitates gripping of the insulating members by the automated case erector 20, as well as securing the insulating members to the case blank 100 prior to folding the combination of case blank and insulating members into a three-dimensional shape.

Figure 3:
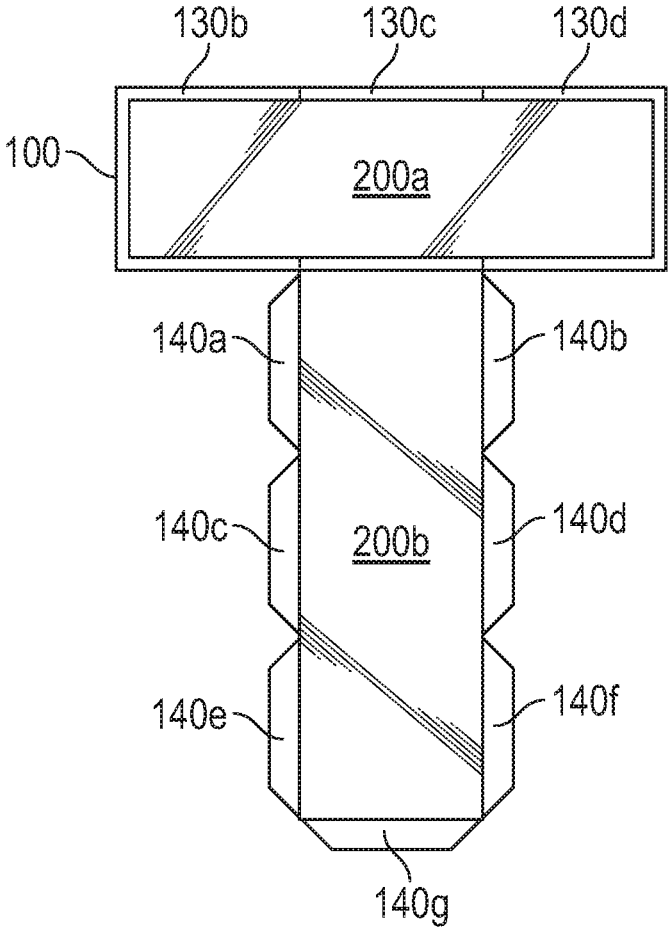
FIG. 3 shows a top view of an illustrative case blank and insulation template secured together that may be formed into a three-dimensional container using the automated case erector shown in FIG. 1 in accordance with the present disclosure.

FIG. 2 shows an illustrative case blank 100 and insulation template 200 before the separate components are secured to each other by the automated case erector 20. FIG. 3 shows a case blank 100 with an insulation template 200 comprising two insulating members 200*a* and 200*b* secured to the case blank by the case erector. FIG. 4 illustrates a fully erected container 10 (with the lid open) after the case blank 100 and insulation template 200 have been formed by the case erector 20. It should be understood by one skilled in the art that the case blank 100 and corresponding insulation template 200 illustrated in FIGS. 2-4 are illustrative only and that the present case erector 20 may be adapted to form a one-piece container 10 formed from variously configured case blanks 100 of varying shapes and sizes and still fall within the scope of the present disclosure.

The case blank feeder 300 is configured to sequentially feed a plurality of case blanks 100 stacked face-to-face. The stack may be replenished as needed by an operator using a forklift or similar means. In a preferred embodiment, as shown in FIG. 1, the case blank feeder 300 comprises a robotic arm 302 configured to pick up individual case blanks 100 from the stack of case blanks and sequentially place each one onto an indexing conveyor 330. The conveyor then conveys each case blank 100 to the insulation securing station 310 and finally the case erecting assembly 320 for final case 10 forming. Preferably, the robotic arm 302 utilizes one or more suction heads for gripping individual case blanks 100 to hold the case blanks while transferring the blanks 100 to the conveyor 330. However, it should be understood that any suitable type of gripper may be utilized, including other types of mechanical grippers such as mechanical grippers utilizing moveable fingers. In other embodiments, other types of feeders may be utilized that do not grip the blanks but sequentially transfer individual case blanks by other suitable means.

Once a case blank 100 is fed onto the conveyor 330, the case blank moves along a line of conveyance through a first adhesive application system, which is preferably a glue nozzle system 340, as shown in FIG. 1. The glue nozzle system 340 may comprise a bar positioned over the conveyor 330 such that each case blank 100 passes below the bar. One or more nozzles are attached to the bar for spraying fluidized adhesive onto a surface of each case blank 100 for securing each of the insulating members 200*a* and 200*b* to the case blank. Utilizing the case blank 100 shown in FIG. 2, adhesive is preferably applied only to sections 130*a* and 130*c*. After adhesive is applied to appropriate sections of each case blank 100 as it passes through the glue nozzle system 340 on the conveyor 330, the case blank 100 moves to an insulation securing station 310 to secure the insulating members 200*a* and 200*b* to the case blank 100. In a preferred embodiment, the insulation securing station 310 also utilizes a robotic arm 312 to pick up each of the insulating members 200*a* and 200*b* and place the insulating members onto a case blank 100 in the appropriate position for securing the insulating members to the case blank 100 to which adhesive has been applied. The insulating members are preferably stacked face-to-face in separate stacks (as they are preferably slightly different sizes), as shown in FIG. 1. Preferably, the arm 312 has a plurality of suction heads and is configured to pick up both insulating members 200*a* and 200*b* in one step and place both onto a case blank 100, which is positioned in a programmed location on the indexing conveyor 330, in a proper orientation, which is illustrated in FIG. 3. When placed onto a case blank, the encapsulating material of the insulating members 200, which is preferably a flexible plastic bag or sheet, contacts the fluid adhesive previously applied to the upward facing side of the case blank 100 to secure the insulation 200 to the case blank 100. Thus, once the insulating members are placed onto the case blanks by the insulation securing station, insulating member 200*a* is secured to section 130*c* of the blank and member 200*b* is secured to section 130*a*. Thus, in this preferred embodiment, only a centralized portion of insulating members 200*a* and 200*b* is secured to each case blank 100. This allows some flexibility in the insulating members when folding the combination of case blank 100 and insulating members 200 secured thereto so that the insulating members are not stretched due to multiple attachment points to the case blank, which may allow the insulation to fit better within the erected container 10. In addition, at least one side of the encapsulating material of each insulating member, which is preferably the interior facing side, may be perforated with a plurality of small holes to allow air trapped within the encapsulating material to escape when folding the insulating member to erect the case, which may cause the insulating member to become partially compressed.

As previously noted, the case blank 100 and insulation template 200 shown in FIGS. 2 and 3 represent one preferred, illustrative embodiment utilized to form the container shown in FIG. 4, though it should be understood that the present case erector 20 may be modified to accommodate case blanks of varying shapes and sizes, as well as one or more corresponding insulating members adapted to work with a desired case blank to produce a one-piece insulating container 10. In any particular embodiment of container, the case blank 100 is from a unitary piece of material adapted to foldably form a three-dimensional container 10, as shown in FIG. 4, from a generally flat blank, as shown in FIGS. 2 and 3. The case blank 100 is manipulated by the automated case erecting assembly 320 to form and retain a three-dimensional shape that defines an interior volume in which items may be placed for shipping. The insulation template 200 is disposed within the container 10 when fully formed, as best shown in FIG. 4. As such, the case blank 100 defines the exterior of the container 10. To enable the case blank 100 to transform from a flat configuration into a three-dimensional configuration, the case blank 100 has a series of fold lines, as represented by the dashed lines on the case blank, as best illustrated in FIG. 2. The fold lines function as living hinges by which various sections of the case blank 100 may be folded to form a three-dimensional shape. The fold lines may be formed by scoring, creasing, or perforating certain portions of the case blank. In some instances, the fold lines may be formed by reducing the thickness of one or more defined portions of the case blank 100. The case blank 100 may be made of a cardboard material that defines a single-face board, a single wall board, a double wall board, or a triple wall board. Alternatively, the case blank 100 may at least partially comprise plastic, rubber, or any other suitable material known for forming containers.

In the particular embodiment of case blank 100 described herein for the purpose of describing the case erector 20, the case blank 100 may preferably have a "T" shape and be divided into six sections 110, 120, 130*a*, 130*b*, 130*c*, and 130*d*, with each section corresponding to one of a top, a bottom, and four sides, respectively, of the container 10, as shown in FIG. 2. In this embodiment, section 110 preferably corresponds to the bottom of the container, and section 120 preferably corresponds to the top of the container, which forms a lid for opening and closing the container, as shown in FIG. 4. Sections 130*a*, 130*b*, 130*c*, and 130*d* preferably correspond to each of four sides of the container, respectively. Fold lines or cuts, as represented by the dashed lines on the case blank shown in FIG. 2, divide the individual sections and function as living hinges to facilitate folding between sections when forming the case blank 100 into a three-dimensional container. Sections 130*b*, 130*c*, and 130*d* represent the horizontal "upper" portion of the "T" shaped case blank, and sections 110, 130*a*, and 120 represent the vertical "lower" portion of the "T" shaped case blank, as shown in FIG. 2. Section 110, which forms the bottom of the container, directly connects section 130*a* to section 130*c*. Sections 110 and 120, which respectively form the bottom and the top of the container, are the same size. In a preferred embodiment, all sections may be approximately the same size to form a box, though the width of sections 130*a*, 130*b*, 130*c*, and 130*d* may be equivalently changed to alter the height of the box formed.

In a preferred embodiment, the section 110 that forms the bottom of the container has two opposing tabs 140*a* and 140*b* for securing the bottom section 110 to opposing side sections 130*b* and 130*d*. In addition, the section 120 that forms the top of the container preferably has three tabs 140*e*, 140*f*, and 140*g* attached to three respective sides of the top section 120. A fourth side of the top section 120 is directly attached to side section 130*a*. Side section 130*a* additionally has two opposing tabs 140*c* and 140*d* for securing side section 130*a* to opposing, adjacent side sections 130*b* and 130*d*. The tabs 140 preferably have beveled edges so that the tabs do not overlap once the case blank 100 has been formed into a three-dimensional box 10, as shown in FIG. 4. The three remaining side sections 130*b*, 130*c*, and 130*d* do not have tabs attached thereto. The boundary of each section may be defined by fold lines, which may include cuts or perforations, that facilitate folding of the case blank into a three-dimensional shape. The "T" shape design of the case blank may be preferred in order to minimize the amount of material required for each container, thereby reducing the amount of waste produced and minimizing the cost of each unit constructed.

In addition, fold lines separate sections 110, 130*a*, and 120 from the tabs attached thereto to facilitate folding the tabs when forming the container. The tabs 140 are relatively narrow strips of material relative to the case blank sections to which the tabs are attached. Preferably, only enough material is used for the tabs 140 to adequately secure the container together, as discussed below, to achieve a desired container strength for holding a desired content weight without using excess material. In a preferred embodiment, the tabs 140 are each about 2 inches in width. In another preferred embodiment, the case blank sections are each about 12 inches in length and 12 inches in width.

In a preferred embodiment, the insulation template 200 comprises two insulating members 200*a* and 200*b*, as shown in FIG. 2. Alternatively, the insulation template may be a single member also having a "T" shape mirroring the shape of the case blank 100 with the size of the insulation template 200 adjusted as discussed below. In a preferred embodiment, each insulating member 200*a* and 200*b* has a generally rectangular shape, as shown in FIG. 2. Additionally, the bag encapsulating the insulating fibers is adapted to have a generally rectangular shape having a desired thickness depending on the level of insulation required for a particular application. Each insulating member 200*a*, 200*b* preferably has a thickness that is at least two times as thick as the thickness of the case blank 100. In a preferred embodiment, each insulating member 200*a*, 200*b* is about one-quarter to two inches thick when in a decompressed state, as best seen in FIG. 4. The bag encapsulating the insulating fibers is sealed with the insulation fibers enclosed so that each of insulating members 200*a* and 200*b* form a unitary insulation member that can be secured to the case blank 100 by the insulation securing station 310. The insulating members 200 are secured to an interior surface of the case blank 100, as shown in FIGS. 3-4, by the fluidized adhesive applied to the interior surface of the case blank. As used herein, the interior surface of the case blank is the surface visible in FIG. 2, which forms the interior of the three-dimensional container, and the exterior surface is the opposite side of the case blank, which forms the exterior of the container.

The insulation template 200 is sized, shaped, and secured to the case blank 100 such that when the case blank 100 is manipulated to form a box, the insulation template 200 cushions and insulates the top, bottom, and each side of the formed box, as best shown in FIG. 4. This ensures that the insulation template forms a complete thermal envelope with insulation on all sides within the box (when the lid is closed) so that there is no thermal "leak" that would reduce the thermal insulation properties by allowing heat transfer between the interior of the closed container and the exterior that is unobstructed by the insulation template. In a preferred embodiment, as shown in FIG. 3, insulating member 200*b* is sized so that the perimeter of the insulating member is flush with the perimeter of case blank sections 110, 130*a*, and 120. However, insulating member 200*a* is preferably sized so that the insulating member is smaller, which means that the perimeter of the insulating member 200*a* substantially covers but is not flush with the perimeter of case blank sections 130*b*, 130*c*, and 130*d*, but instead is slightly smaller than the area of these three sections combined. Thus, when member 200*a* is secured to section 130*c*, the case blank sections extend outward from the member 200*a* around the perimeter of member 200*a* to form an edge section of case blank, as shown in FIG. 3. The width of this edge section is approximately the same as the thickness of the insulating members 200, which allows the members 200*a* and 200*b* to fit flush together when forming the box to ensure a complete thermal envelope is formed within the interior of the box. Thus, as used herein, the insulation template 200 "covers" sections of the case blank 100 when the insulating members 200 are flush with the perimeter of such sections or when the insulating members 200 substantially cover such sections but leave an uncovered edge section of the case blank 100 that is approximately the width of the thickness of an insulating member 200.

Once the insulating members 200 are secured to the case blank 100 by the insulation securing station 310, the case blank is moved by the conveyor 330 along the line of conveyance through a second adhesive application system, which is preferably also a glue nozzle system 350, as shown in FIG. 1. The second glue nozzle system 350 preferably also comprises a bar positioned over the conveyor 330 such that the combination of case blank 100 and insulating members 200 secured thereto passes below the bar. One or more nozzles are attached to the bar for spraying fluidized adhesive onto an interior surface of the tabs 140 of the case blank for securing the sections of the case blank to each other to erect the container 10. Preferably, glue or a similar adhesive material is applied to the interior surface of each of tabs 140*a*, 140*b*, 140*c*, and 140*d*. Once folded into place by the case erecting assembly 320, tabs 140*a* and 140*b* secure bottom section 110 to side sections 130*b* and 130*d*. Similarly, tabs 140*c* and 140*d* secure side section 130*a* also to side sections 130*b* and 130*d*, as best seen in FIG. 4.

Once adhesive is applied to the tabs 140 by the second glue nozzle system 350, the unit case blank 100 with insulating members 200 secured thereto is moved by the conveyor 330 along the line of conveyance to the case erecting assembly 320. The case erecting assembly 320 is configured to receive each case blank 100 having a respective insulation template 200 secured to the case blank 100 and to simultaneously fold portions of each flat case blank 100 and corresponding portions of each insulation template 200 secured to the case blank 100 into an erected case 10. Thus, the case erecting assembly 320 is an automated system that forms the generally flattened combination of case blank and insulating members secured thereto into a three-dimensional container. Preferably, the case erecting assembly 320 may utilize a robotic arm 322 to pick up the combination and move it as a unit into the erecting assembly 320 for case forming. A variety of case erectors are currently known in the art for forming cases from blanks of varying shapes and sizes by folding the blanks along fold lines in a variety of configurations. It should be understood that the case erecting assembly 320 of the present case erector 20 may be adapted to form an insulating one-piece container from a variety of case blanks and associated insulation and still fall within the scope of the present disclosure.

Once each combination of case blank and insulating members reaches the case erecting assembly 320, the assembly preferably forms the case 10 by first folding sections 130*b* and 130*d* upward so that these sections are positioned at a 90-degree angle relative to section 130*c*. The conveyor 330 or robotic arm 322 may then move the combination over a forming mandrel for forming the case. The robotic arm 322 or a separate head associated with the case erecting assembly 320 may then push downward on section 110 to move the combination downward through the mandrel to form the case. This action folds the case blank so that sections 130*c* and 130*a* (and consequently 130*b* and 130*d* because they have already been folded to a 90-degree angle) are at a 90-degree angle to section 110, which forms the bottom of the container. When the case blank 100 is folded along the fold lines, the insulating members 200 are simultaneously folded along corresponding "lines" on the insulating members. To facilitate folding the insulating members, the insulating members may optionally be mitered along a corresponding fold line. For instance, a linear "V" cut may be made in each insulating member 200 along the line where the member is folded so that the insulating material contained within the encapsulating bag does not have to bend when folding the insulating members. Both insulating members 200*a* and 200*b* may have such mitering along all fold lines.

After all of the side sections 130 have been appropriately folded, the combination may be pushed farther down into the forming mandrel to fold tabs 140*a* and 140*b* upward to a 90-degree angle. Because adhesive has been applied to the tabs, this action secures bottom section 110 to side sections 130*b* and 130*d*. The case erecting assembly 320 may then fold tabs 140*c* and 140*d* each to a 90-degree angle to secure side section 130*a* to side sections 130*b* and 130*d*. Once these folds have been made, the container 10 is formed with the lid 120 open at a 90-degree angle, as shown in FIG. 4. The erected case may then be discharged from the case erecting assembly 320 by a discharge conveyor 360 to a discharge location. In one embodiment, a robotic arm, which may be erecting assembly robotic arm 322, may pivot to move the erected box to a separate assembly line conveyor for erected cases.

The final step is to fold section 120, which forms the lid of the container, to close the container. Section 120 preferably has three tabs 140*e*, 140*f*, and 140*g* on three sides. Tabs 140*e* and 140*f* may be folded to secure the lid 120 to sidewall sections 130*b* and 130*d*, respectively, and tab 140*g* may be folded to secure the lid 120 to sidewall section 130*c*. Because items for shipping will later be placed into the container for shipping the items, the step of closing the lid is preferably done manually by a user at a later time. Thus, adhesive may optionally not be applied by the second glue nozzle system 350 to the tabs attached to the lid. In addition, to allow the user to open and close the lid for reuse, tabs 140*e*, 140*f*, and 140*g* may optionally have re-sealable adhesive strips secured thereto that allow repeated opening and closing of the lid. Alternatively, a user may use tape or a similar adhesive to secure the lid closed before shipping, and the tape may later be removed to open the container.

Once the top section 120 is folded to close the lid of the container, the container will be closed by a padded top wall, which is part of insulating member 200*b*. At this point, the container 10 defines a completely enclosed, padded interior volume in which items desired for shipment may be housed during transit. The size and shape of the insulating members 200*a* and 200*b* are adapted so that the members fit flush together and flush around the entire interior of the container to form a complete thermal envelope within the container. As used herein, this container is referred to as a "one-piece" insulating container, meaning that the exterior of the container (formed by the case blank 100) and the insulation disposed within the container are secured together to form a single unit that may be manipulated into a three-dimensional container using automated machinery as a unit or optionally manually as a unit. This differs from known shipping containers which require separate installation of insulating material after constructing or forming the shipping container.

The dimensions of each component of the container 10 described herein may be adjusted to form containers of varying dimensions. For instance, the case blank 100 and/or insulation template 200 discussed above may be shaped and sized to correspond to standard sized boxes or containers used by the United States Postal Service or other freight carriers, such as FedEx or UPS, for shipping fragile or temperature-sensitive items.

Figure 5:
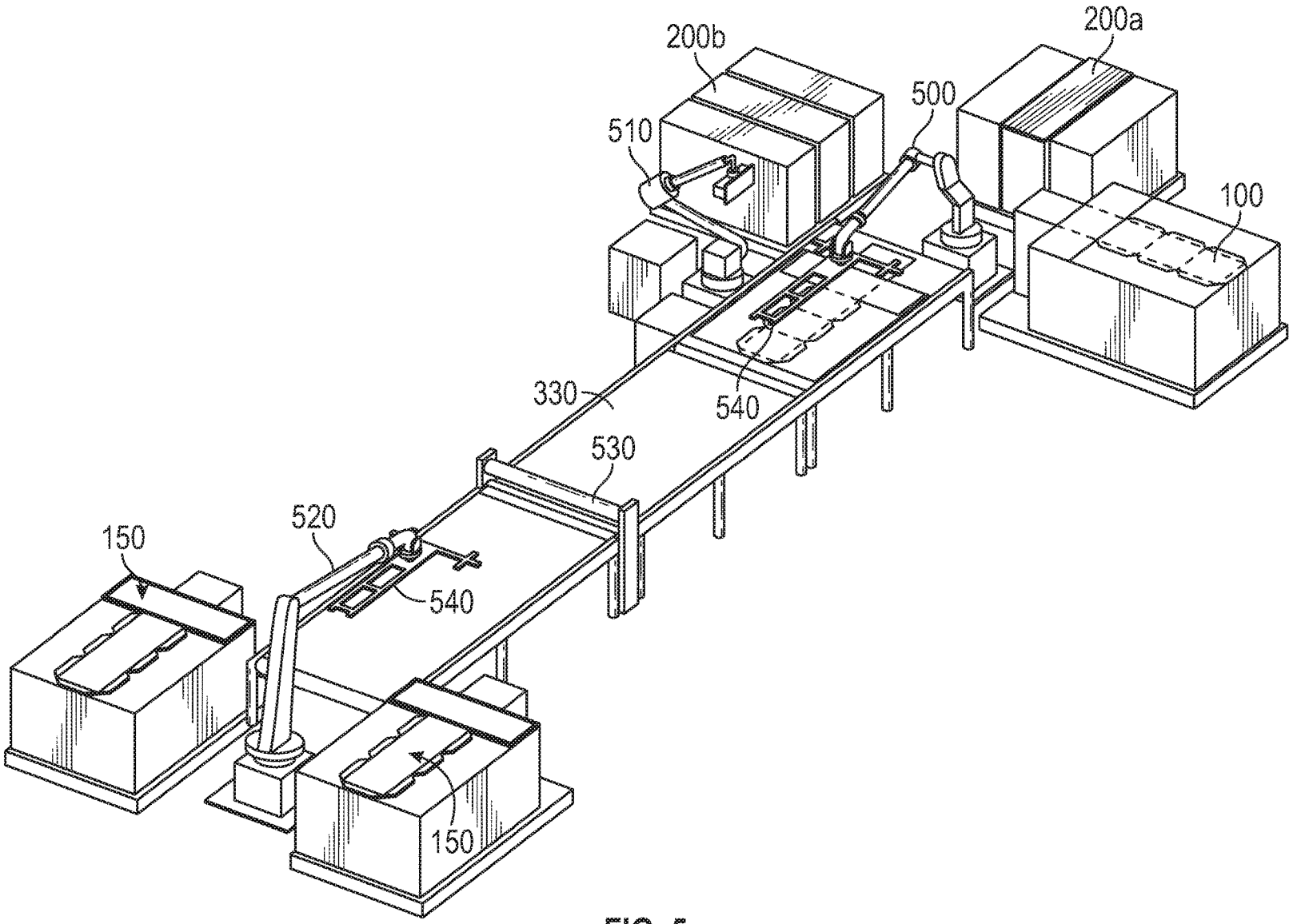
FIG. 5 shows a perspective view of elements of an automated case erector apparatus in accordance with the present disclosure.

FIG. 5 illustrates an alternative embodiment of a case erector 20. In this embodiment, a robotic arm 500 first picks up a case blank 100 and places it onto the conveyor 330. A second robotic arm 510 then applies adhesive to appropriate locations on the case blank as described above, including on the tabs 140. The first arm 500 also picks up insulating members 200*a* and 200*b* and places them onto the case blank 100 after adhesive has been applied to secure the insulating members to the case blank. The conveyor 330 then moves the combination 150 of case blank 100 and insulating members 200 secured thereto toward a third robotic arm 520. The combination 150 may pass through a roller 530 to ensure that the insulating members are flattened as much as possible. The third robotic arm 520 then picks up the combination 150 and stacks each unit 150 of case blank and secured insulating members face-to-face with an exterior side of each case blank 100 contacting an interior side of an insulation template 200 of a unit below. This arrangement may be utilized to leave the combinations of blanks and insulation in a generally flattened shape for storage or for shipping the flattened combinations to another location for on-site case erecting. Alternatively, the third arm 520 may transfer the combination directly to a case erecting assembly 320, such as that shown in FIG. 1.

In a preferred embodiment, as shown in FIG. 5, each of the robotic arms used to pick up the case blanks 100, insulating members 200, or combination thereof may utilize a pick-up head 540 having a footprint that generally conforms to the shape of the case blank or combination blank and insulation. The head 540 may have a plurality of individual suction heads arranged in various positions on the head 540 to provide multiple pick-up points to ensure the case blank, insulating members, or combination thereof do not bend while being lifted and moved by the robotic arm. Thus, in the presently illustrated case, each head 540 generally has a "T" shape, as shown in FIG. 5, so that the T-shaped footprint of the pick-up head 540 conforms to each T-shaped case blank 100, though the shape of each head may be modified to fit blanks having various shapes and sizes and still fall within the scope of the present disclosure. The pick-up heads 540 shown in FIG. 5 may preferably be utilized with the robotic arms 302, 312, 322 of the automated case erector 20 shown in FIG. 1.

The devices and methods shown and described herein are exemplary. Though certain characteristics of the present disclosure are described above, the description is illustrative only. It is understood that versions of the container disclosed above may come in different forms and embodiments. Additionally, it is understood that one of skill in the art would appreciate these various forms and embodiments as falling within the scope of the invention as disclosed herein.

What is claimed is:

1. A method of erecting a case, said method comprising the steps of:

providing an automated case erector apparatus comprising:

a case blank feeder configured to sequentially feed a series of flat case blanks onto a conveyor, an insulation securing station configured to secure an insulation template to each respective flat case blank on the conveyor, and a case erecting assembly configured to receive each case blank having a respective insulation template secured to the case blank and to simultaneously fold portions of each flat case blank and corresponding portions of each insulation template secured to the case blank into an erected case;

providing a plurality of case blanks;

providing a plurality of insulation templates;

sequentially feeding the case blanks, by the case blank feeder, onto the conveyor;

securing an insulation template to each respective case blank on the conveyor, by the insulation securing station; and erecting a case, by the case erecting assembly, from a combination of each case blank and a respective insulation template by simultaneously folding the case blank and the insulation template into a case having an insulated interior.

2. The method of claim 1, wherein the case erector apparatus further comprises an adhesive application system configured to apply fluidized adhesive onto a surface of each case blank on the conveyor, wherein the step of securing an insulation template to each respective case blank comprises applying adhesive to each case blank and placing the insulation template onto the case blank.

3. The method of claim 1, wherein each case blank comprises a plurality of tabs, wherein the case erector apparatus further comprises an adhesive application system configured to apply fluidized adhesive onto a surface of each tab, wherein the step of erecting a case by simultaneously folding the case blank and the insulation template comprises applying adhesive to each tab and securing sections of each case blank together by folding the tabs.

4. The method of claim 1, wherein the case blank feeder comprises a robotic arm comprising a pick-up head having a footprint that conforms to the shape of each case blank.

5. The method of claim 1, wherein the insulation securing station comprises a robotic arm comprising a pick-up head having a footprint that conforms to the shape of each case blank.

6. The method of claim 1, wherein the case erecting assembly comprises a robotic arm comprising a pick-up head having a footprint that conforms to the shape of each case blank.

7. The method of claim 1, wherein each insulation template comprises two insulating members, wherein the step of securing an insulation template to each respective case blank comprises securing both insulating members to the case blank.

8. The method of claim 1, wherein each insulation template comprises fibers contained within an encapsulating material.

9. An automated case erector apparatus comprising:

a case blank feeder configured to sequentially feed a series of flat case blanks onto a conveyor;

an insulation securing station configured to secure an insulation template to each respective flat case blank on the conveyor; and a case erecting assembly configured to receive each case blank having a respective insulation template secured to the case blank and to simultaneously fold portions of each flat case blank and corresponding portions of each insulation template secured to the case blank into an erected case having an insulated interior.

10. The apparatus of claim 9, wherein the case erector apparatus further comprises an adhesive application system configured to apply fluidized adhesive onto a surface of each case blank on the conveyor.

11. The apparatus of claim 9, wherein each case blank comprises a plurality of tabs, wherein the case erector apparatus further comprises an adhesive application system configured to apply fluidized adhesive onto a surface of each tab.

12. The apparatus of claim 9, wherein the case blank feeder comprises a robotic arm comprising a pick-up head having a footprint that conforms to the shape of each case blank.

13. The apparatus of claim 9, wherein the insulation securing station comprises a robotic arm comprising a pick-up head having a footprint that conforms to the shape of each case blank.

14. The apparatus of claim 9, wherein the case erecting assembly comprises a robotic arm comprising a pick-up head having a footprint that conforms to the shape of each case blank.

15. The apparatus of claim 9, wherein each insulation template comprises two insulating members.

16. The apparatus of claim 9, wherein each insulation template comprises fibers contained within an encapsulating material.

* * * * *